United States Patent [19]

Helpinstill, II

[11] 4,376,402

[45] Mar. 15, 1983

[54] FOLDING PIANO

[76] Inventor: Charles T. Helpinstill, II, 5808 S. Rice Ave., Houston, Tex. 77081

[21] Appl. No.: 160,442

[22] Filed: Jun. 18, 1980

[51] Int. Cl.[3] ..... G10C 3/12

[52] U.S. Cl. ..... 84/176; 84/431

[58] Field of Search ..... 84/174, 176, 177, 431

[56] References Cited

U.S. PATENT DOCUMENTS

| | | | |
|---|---|---|---|
| 473,308 | 4/1892 | Fischer | 84/431 |
| 1,794,783 | 3/1931 | Lundholm | 84/431 |
| 1,827,096 | 10/1931 | Morse | 84/431 |
| 1,958,920 | 5/1934 | Kumle | 84/431 |
| 2,058,001 | 10/1936 | Colwin et al. | 84/431 |
| 2,505,805 | 5/1950 | Stein | 84/174 |

*Primary Examiner*—L. T. Hix
*Assistant Examiner*—Alan Mathews
*Attorney, Agent, or Firm*—Gunn, Lee & Jackson

[57] ABSTRACT

A portable folding piano is disclosed which incorporates in the preferred and illustrated embodiment, a keyboard and associated keys which disengage from the hammer pickup fingers. The keyboard is pivotally attached to the piano body and may be swung to a stored position for transportation purposes. A positioning rail aligns the hammer pickup fingers for reengagement with the piano keys which are provided with a forked extension to enable repeated and accurate engagement.

10 Claims, 9 Drawing Figures

FIG. 4
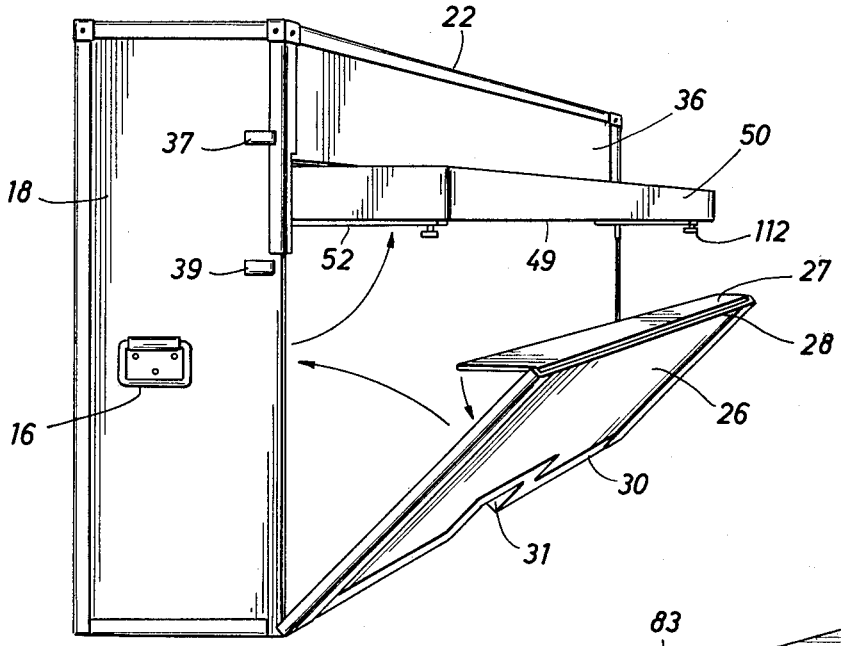
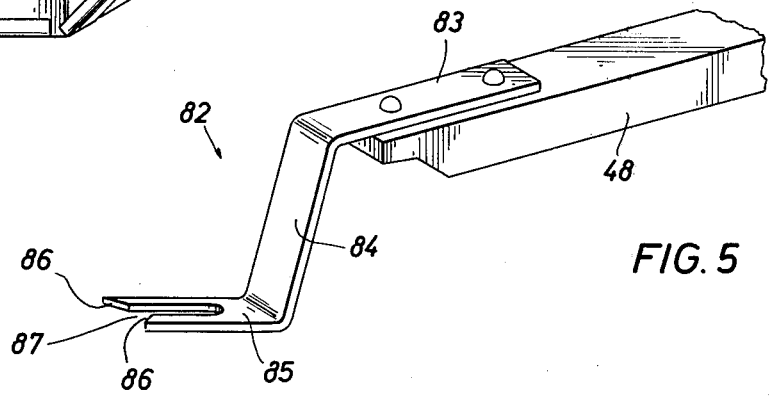
FIG. 5
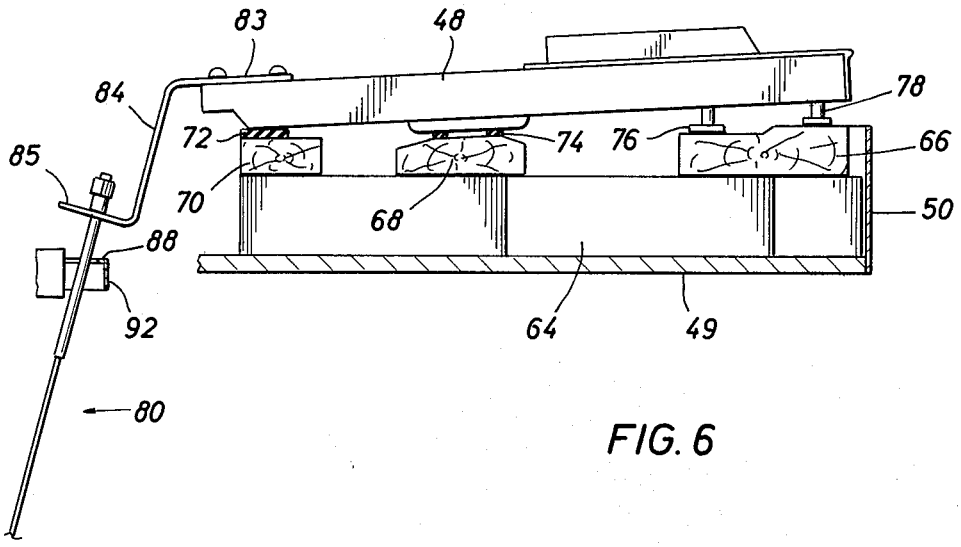
FIG. 6

FOLDING PIANO

BACKGROUND OF THE DISCLOSURE

The invention generally relates to musical instruments of the type having a keyboard and, more particularly concerns improvements in portable keyboard musical instructions such as a piano.

A piano is a very popular instrument with small instrumental groups. It is a device which has substantial bulk and weight as a result of its size. With small travelling musical entertaining groups, the piano must nevertheless, be moved from engagement to engagement. This is difficult to accomplish as a result of the size, weight and bulk of a piano. In particular, the bulk is such that, coupled with its weight, the piano is very difficult to handle by even strong workmen. This is true of both standard percussion piano instruments and electronic keyboard instruments.

For some time, there has been an urgent demand and unfilled need for a portable keyboard instrument capable of quick assembly and disassembly and thereby adapted for travel with the musicians, preferably by car, bus or similar vehicle. While the industry has recognized this need, portable keyboard instruments known in the prior art may be characterized as cumbersome and having the weight and mass of a conventional piano. Other factors have prevented any marked advancement and development in meeting the above noted need, not the least of which is the difficulty of providing a portable keyboard instrument structure capable of convenient assembly and disassembly which also is capable of maintaining requisite instrument integrity, especially in tone quality.

SUMMARY

The present invention is directed to an improved portable piano capable of quick assembly and disassembly, particularly characterized by a compact construction for easy transportation. The piano of the invention incorporates an upright body type construction. The keyboard assembly is pivotally rotatable to a stored position within the body of the piano. This forms the piano to define a box-like package which is easily transportable and may be readily handled by one or two workmen.

When folded for transportation, the piano of the invention presents an closed box-like structure. It may be mounted on rollers for more convenient transportation. Rollers are not required, however, as the piano of the present invention may easily be manuevered by one or two workmen utilizing a standard moving dolly or the like.

The keyboard of the present invention is pivotally attached to the sides of the piano body. It is provided with a slide bar locking mechanism for locking the keyboard in a horizontal playing position. Manipulation of the locking mechanism disengages the keyboard from the horizontal position permitting it to be swung downwardly to a substantially vertical storage position.

One feature of the present invention permits the playing keys to be disengaged from the hammer pickup fingers and subsequently be reengaged without interferring in key operation or loss in tone quality. This is accomplished by a feature of the invention wherein the keys are provided with profiled extensions which engage the pickup fingers connected to the piano hammers. Each extension incorporates an open ended slot at one end thereof for receiving the shaft of the pickup fingers which are positioned in substantially the same position at all times. This is accomplished by a positioning rail mounted to the backside of the piano hammer rail. The positioning rail comprises lightweight metal strips that include a plurality of slots for accepting the shaft of the piano pickup fingers. When the keyboard is in the horizontal or playing position, the pickup fingers are captured within the slots of both the key extension and the positioning rail. In this position, the slots are in substantial vertical alignment; the key extensions being spaced above the positioning rail. It will be appreciated that the positioning rail and key extensions cooperate to insure that the pickup fingers are engaged at substantially the same point every time the keyboard is pivoted to the playing position. Thus, the piano of the invention does not require regulation after each use.

It maintains a high tone quality while only requiring the usual maintenance of a conventional piano.

Another feature of the invention is directed to reducing noise or clatter resulting from the engagement of the pickup fingers with the metallic positioning rail. To this effect, a portion of the shaft of the pickup fingers is enclosed in a flexable sheath of plastic material or the like.

In summary, the piano of the present invention can be characterized as having the overall appearance of a conventional upright piano when in use. However, the similarity to a conventional piano extends to overall appearance only, for the piano of the present invention includes a pivotal keyboard adapted for disengagement and folding to a storage position. Thus, the piano is easily transportable in the manner described herein to meet the needs of traveling instrumental groups.

BRIEF DESCRIPTION OF THE DRAWINGS

So that the manner in which the above recited features, advantages and objects of the invention, as well as others which will become apparent, are attained and can be understood in detail, a more particular description of the invention briefly summarized above may be had by reference to the embodiments thereof illustrated in the appended drawings, which drawings form a part of this specification. It is to be noted, however, that the appended drawings illustrate only typical embodiments of the invention and are not to be considered limiting of its scope, for the invention may admit to other equally effective embodiments.

FIG. 4 is a perspective view of the present invention generally showing the manner in which the keyboard and the front panel of the piano may be pivoted in position;

FIG. 5 is a perspective view of a piano key of the present invention;

FIG. 6 is a cross-sectional side view of the keyboard assembly showing a piano key of the invention in cooperating engagement with a piano pickup finger;

DETAILED DESCRIPTION OF THE PREFERRED EMBODIMENT

Figure 1:
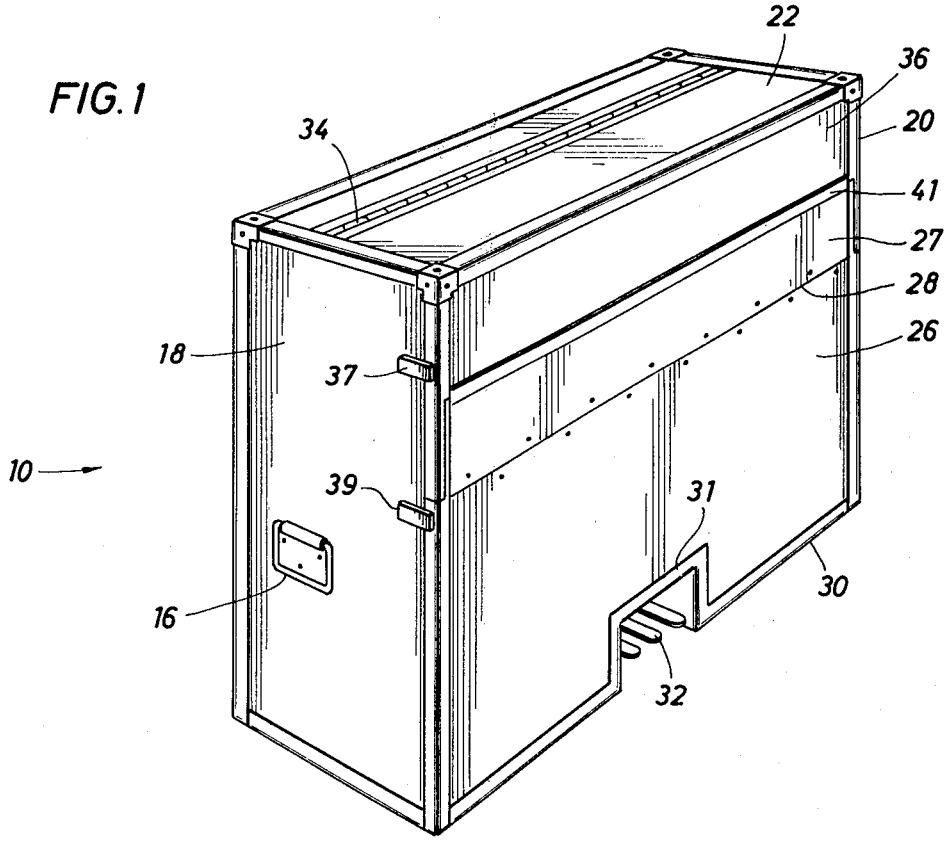
FIG. 1 is a perspective view of a preferred embodiment of te piano of the present invention.
Figure 2:
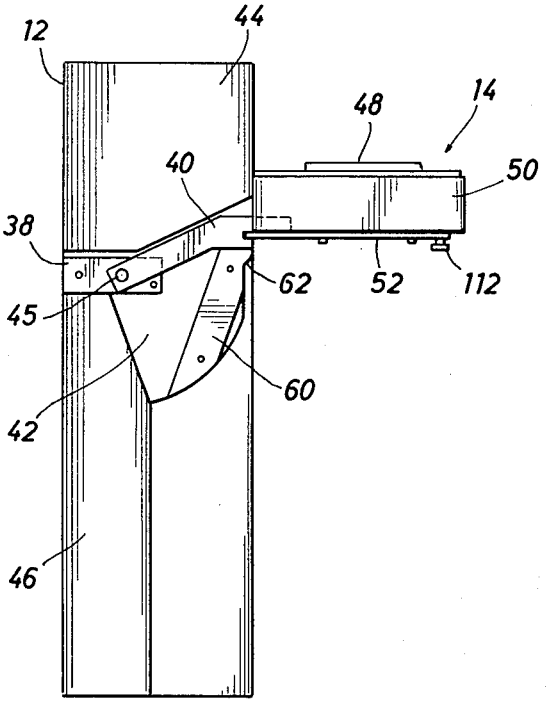
FIG. 2 is a side view of the present invention with the piano side panels removed showing the pivot arm structure of the keyboard assembly.
Figure 3:
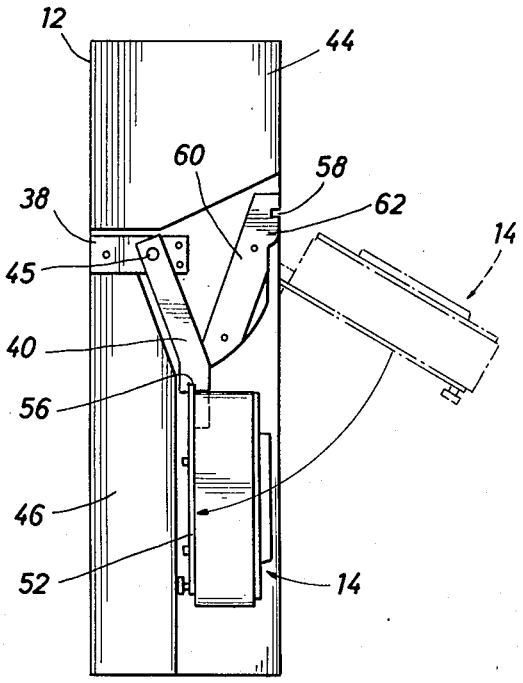
FIG. 3 is a side view of the invention shown in FIG. 2 with the keyboard assembly pivoted to a stored position.

Referring first to FIGS. 1 through 3, a preferred embodiment of the present invention is disclosed. It will be recognized that the piano according to this invention is indicated generally by the reference numeral 10. As shown, the piano 10 comprises a generally upright piano back unit 12 and a keyboard unit 14 pivotally attached to the piano 10 in horizontal playing position. In FIG. 3, the keyboard 14 is shown full line in the pivoted or stored position.

In FIG. 1, the piano 10 is shown in a folded or knocked-down condition ready for transportation. It will be recognized that the piano 10 becomes a substantially rectangular upright box in a manner which will be described more fully hereinafter. The piano keyboard 14 is housed within the piano 10 as shown in FIG. 3. The piano 10 may be mounted on rollers (not shown in the drawings for the sake of clarity) and is provided with handle means 16 on each of the side panels 18 and 20. Thus, the piano 10 may be readily folded into the unit shown in FIG. 1, capable of being easily handled and moved by one or two individuals.

Dwelling now more particularly on the features of the piano 10, the same comprises a substantially rectangular shaped box or housing having upright rectangular side panels 18 and 20, a rectangular top panel 22, a planar back panel 12 and a substantially planar front panel comprising coplanar upper and lower sections 26 and 27 connected by a hinge 28. The section 26 is substantially rectangular in configuration and is hinged to the base of the piano 10. The section 26 may be pivoted out of the way as shown in FIG. 4 so that the keyboard 14 may be swung into playing or stored position. The lower edge 30 of the section 26 is notched at 31 providing access to the foot pedals 32. For transportation purposes, the foot pedals 32 are positioned in a recess within the piano 10 and do not extend beyond the front section 26 as best shown in FIG. 1.

Referring still to FIG. 1, it will be appreciated that the top panel 22 of the piano 10 is hinged on hinge means 34 whereby the panel is capable of being swung upwardly to provide ready access to the interior of the piano back. The top panel 22 carries the upper most section 36 of the front panel structure therewith. Interiorally, the piano 10 contains a plurality of playing strings stretched in a gernally conventional fashion over a harp means which is affixed to the interior of the piano back cabinet. Latches 37 are provided on the side panels 18 and 20 to secure the top panel 22. Latches 39 secure the front panel section 26 as shown. The uppermost section 36 is provided with an overhanging metal flap 41 along the lower longitudinal edge thereof. When the piano 10 is readied for transporting from one place to another, it is latched and secured as shown in FIG. 1. The section 26 is latched first, then the top panel 22 is swung into latching position. The flap 41 extends over the upper longitudinal edge of the section 27 covering the point where the sections 27 and 36 meet. In addition to securing the section 27 along the upper edge thereof, the flap 41 provides finished appearance to the front panel of the piano 10.

Turning now to FIGS. 2 and 3, the piano 10 is shown with the upright side panels 18 and 20 removed, exposing the subframe of the piano. It will be observed that the keyboard 14 is pivotally attached to the subframe of the piano 10 which is provided with a horizontally directed support plate 38. An angularly extending arm 40 connects the keyboard 14 to the support plate 38 which is securely fastened to the piano subframe. The sides of the piano subframe comprise a double wall construction including an inner wall 42 which supports the plate 38. Two precut sections 44 and 46 are nailed, screwed or otherwise fastened to the inner wall 42. The sections 44 and 46 include spaced and opposed angularly extending edges 45 and 47 which permit free pivotal movement of the keyboard 14 therebetween as shown in FIG. 3. When attached, the side panels 18 and 20 attach to the sections 44 and 46 and are spaced from the inner wall 42 forming a gap or cavity therebetween. The keyboard arm 40 is received in the cavity thus formed and is pivotally connected to the support plate 38 by a bolt 45. A hole is provided near one end of the arm 40 and aligned with a hole through the support plate 38. The bolt 45 is received therethrough. The other end of the arm 40 is securely fastened to the keyboard 14.

The keyboard 14 is of conventional design and generally comprises a rectangular shaped configuration enclosed on three sides. It includes a bottom section 49 for supporting the keyboard assembly. When assembled, the keys 48 are elevated slightly above the surrounding enclosure 50 as show in FIG. 2. The enclosure 50 is provided primarily to give the keyboard 14 a finished look and may be fabricated from metal, wood or any other suitable material.

A locking mechanism incorporating a slide bar 52 locks the keyboard 14 in the horizontal position shown in FIG. 2. The slide bar 52 is mounted to the nether side of the keyboard bottom 49. The slide bar 52 incorporates a pair of slots (not shown in the drawings) for receiving a pair of pins 51 therethrough. Further, the slide bar 52 includes spring means which constantly urge the slide bar to a locking position. When the keyboard 14 is in the up position of FIG. 2, the end 54 of the slide bar 52 is received in a slot 56 formed in the keyboard arm 40 and in a corresponding and aligned recess 58 formed in a angularly disposed support plate 60 which is fixed to the inner wall 42 of the piano subframe. The support plate 60 includes a lobe 62 immediately below the recess 58 for cocking the slide bar 52 in a manner to be described hereinafter. The bar 52 locks the keyboard in position for playing. While only one locking mechanism is described herein, it is understood that an identical locking mechanism is provided on each end of the keyboard 14.

Turning now to the particulars and features of the keyboard assembly, reference is made to FIGS. 5 through 9 of the drawings. As best shown in FIGS. 5 and 6, the keyboard assembly is substantially of conventional design. It includes a keyboard cross rail 64, a front rail 66, a balance rail 68 and a back rail 70. The back rail 70 is provided with key cloth 72 and the balance rail 68 is provided with rail punching 74. The front rail 66 includes front rail punching 76 and front rail pins 78. The keys 48 are arranged in a well known manner to complete the keyboard assembly. The above recited keyboard elements are conventional and well known in the art.

Turning now to FIG. 5, one of the keys 48 is shown. A conventional key has been modified to include the fork extension 82 of the present invention. The extension 82 is fabricated from a malleable metal that has sufficient strength to maintain a predetermined shape. It comprises one integral piece that is shaped to include three segments that are angularly disposed relative to each other as shown in FIGS. 5 and 6. A first segment 83 is securely fastened to the top of the key 48 in a convenient manner, such as riveting. The second segment 84 extends in a downward direction from the first segment 83 and merges with the third segment 85 which extends generally horizontally therefrom. The segment 85 is provided with an open U-shaped slot 87 for engaging the pickup fingers 80. The mouth of the U-shaped slot 87 incorporates inwardly angled edges 86 for guiding the pickup fingers 80 into the slot.

Figure 8:
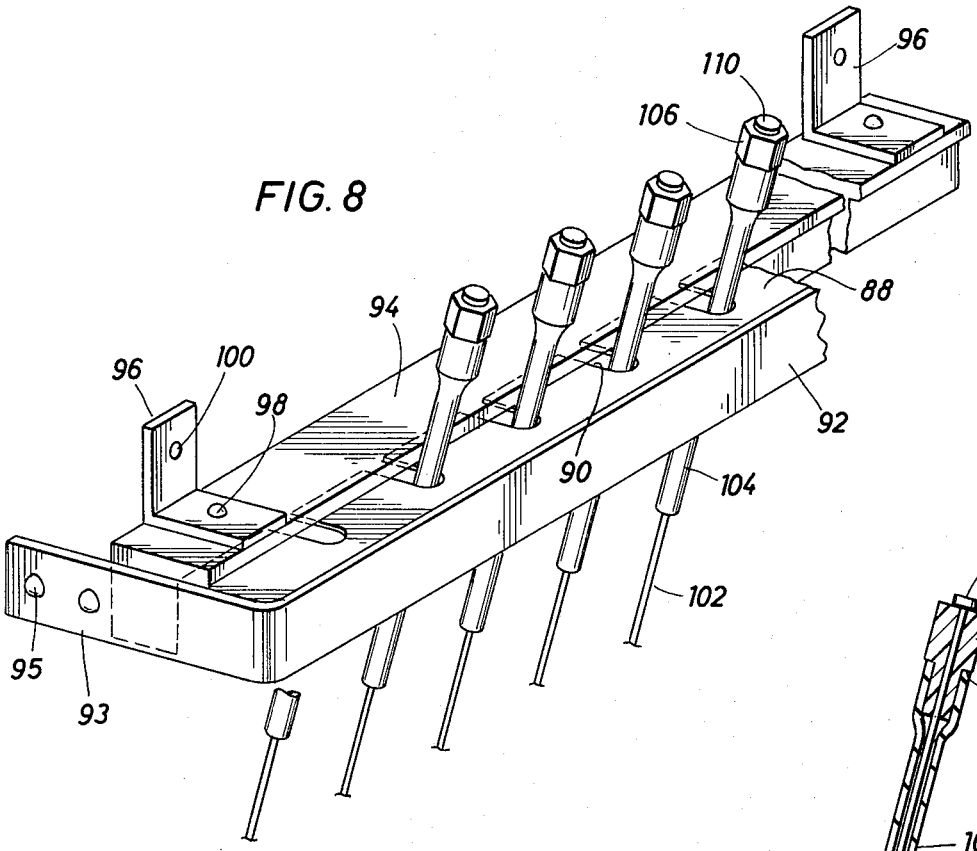
FIG. 8 is a partial perspective view of the positioning rail of the present invention.

Referring now to FIG. 8, the pickup finger positioning rail is disclosed. The rail is an elongate metallic member comprising two strips joined at right angles to each other. The top strip 88 incorporates a plurality of slots 90 for receiving the pickup fingers 80. The side strip 92 extends downwardly from the back and side edges of the top strip 88 adding strength and stiffness to the positioning rail. The strip 92 extends beyond the strip 88 along the side edges thereof for connection to the piano action bracket (not shown in the drawings). The strip extension 93 incorporates a plurality of holes 95 as needed for receiving connecting screws therethrough to securely mount the pickup finger positioning rail to the piano framework. The slots 90 are dimensioned to accept the shafts of the pickup fingers 80 as shown. The width of the slots 90 is slightly greater than the width of the pickup finger shaft so that the pickup fingers 80 may freely move within the slots 90.

A cross bar 94 is provided for connection to the positioning rail as shown in FIG. 8. The cross bar 94 closes off the open ends of the slots 90 for limiting the movement of the pickup fingers 80. An L-shaped bracket connects the cross bar 94 to the top strip 88 as shown. A screw 98 or other connecting means may be used to effect the connection. The upstanding leg of the bracket 94 is adapted for connection to the backside of the piano hammer rail (not shown in the drawings). A hole 100 is provided through the upstanding leg of the bracket 96 for receiving a screw or the like for connection to the hammer rail. A plurality of brackets 96 are spaced along the cross bar 94 as required to adequately support the pickup finger positioning rail.

Figure 9:
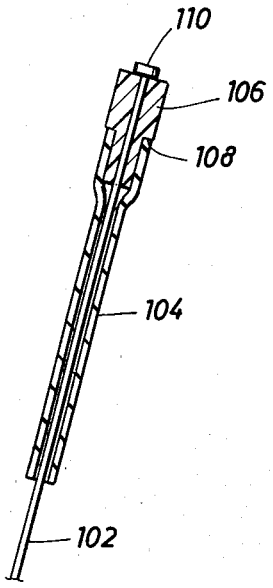
FIG. 9 is a cross-sectional view of the pickup finger sheath of the present invention.

Turning now to FIG. 9, a preferred embodiment of a pickup finger 80 is shown. The pickup finger 80 includes a shaft 102 of conventional design. One end of the shaft 102 is connected to a wippen (now shown in the drawings) which in turn connects to a piano hammer for striking a musical note. The particular design of the piano action assembly is conventional and will not be described further. Suffice it to say that the pickup finger 80 of the present invention connects to the piano hammer to produce a musical note in a well known manner. While only one piano pickup finger is described herein, it is understood that the piano 10 incorporates a plurality of pickup fingers of essentially identical design. The opposite or upper end of the piano finger 80 is provided with a noise reducing sheath 104 and a lock nut 106. The sheath 104 is an elongate cylinder fabricated of flexible material, such as plastic, and includes an axial passage extending therethrough. The internal diameter of the axial passage is slightly greater than the diameter of the shaft 102 so that the sheath 104 is slightly spaced from and does not contact the shaft 102. The upper end of the sheath 104 incorporates an enlargement for receiving a reduced portion of the lock nut 106. The length of the sheath 104 is a scale factor, however, the sheath 104 best encloses the shaft 102 a suitable distance below the metallic positioning rail as shown in FIG. 8.

The lock nut 106 includes a hexagonal portion and a reduced cylindrical portion as best shown in FIG. 9. A downwardly facing shoulder 108 defines the upper limit of the cylindrical portion. The lock nut 106 also includes an axial passage for receiving the shaft 102 therethrough. The cross-sectional diameter of the axial passage extending through the lock nut 106 is substantially the same as the cross-sectional diameter of the shaft 102 for perfecting a frictional connection therebetween. The outer diameter of the reduced portion of the lock nut 106 is substantially equal to the internal diameter of the enlarged portion of the sheath 104 to likewise perfect a frictional connection between the lock nut 106 and the sheath 104 at the joinder thereof. The lock nut 106 and the sheath 104 are joined by pressing the lock nut into the enlargement of the sheath 104 until the shoulder 108 engages the upper circumferential edge of the enlargement. To complete the assembly of the pickup finger 80, an adjustment nut 110 is provided. Manipulation of the adjustment nut 110 permits the stroke of the pickup finger to be varied so that the piano 10 may be regulated in a conventional manner. It will be appreciated that by enclosing the upper portion of the shaft 102 in the manner described above, the metal key extension 82 engages only the plastic sheath 104 enclosing the shaft 102. Substantial noise reduction between keyboard assembly elements is thus established and the tone quality of the piano 10 is improved.

Figure 7:
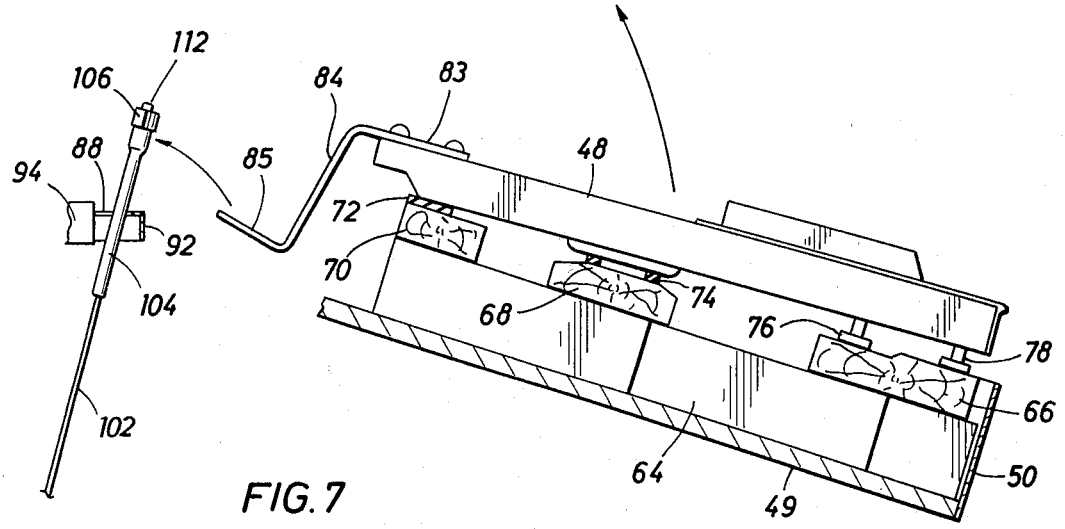
FIG. 7 is a cross-sectional side view of the present invention as shows in FIG. 6 and generally indicating the pivotal movement of the keyboard assembly for engaging a piano pickup finger.

Referring now specifically to FIG. 7, the manner in which a key 48 engages a pickup finger 80 is shown. As the keyboard 14 is pivoted upwardly, the key 48 approaches a corresponding pickup finger 80 which is aligned by the positioning rail (see FIG. 8) for engagement by the key 48. Perfect alignment is not required. Substantial alignment with the approaching key 48 is adequate. The extension slots 87, being provided with angled edges 86, will guide the pickup finger 80 into the slot 87 if necessary. Each pickup finger 80 is engaged immediately below the enlargement of the sheath 104 and rests on the parallel tiens of the slot 87. After engagement, the key 48 is connected to pull the shaft 102. Key motion is transferred to the piano with a full range of pianissimo to fortissimo. A musical note is formed by depressing the key 48 in the usual manner which pivots the extension 82 upwardly. The pickup finger 80 is lifted upwardly as a result and, in turn, causes the associated piano hammer to strike a piano string creating the musical note.

From the foregoing description, it is believed that those familiar with the art will readily recognize and appreciate the novel features which mark the present invention as an advancement in this art. The piano 10 is durable and may be moved many times without loss in tone quality and is particularly adapted for producing a uniform musical tone without requiring substantial regulation subsequent to each move.

In preparing the piano 10 for transportation, reference is made to FIG. 2. To release the locking mechanism, a backward or outward pull is applied thereto by pulling on a conveniently located knob 112. The keyboard 14 is then swung downwardly as shown in FIG. 2. The front panel of the piano 10 is secured in the manner shown in FIG. 1 and the piano is ready for transportation. Upon arrival at its destination, the piano 10 is easily readied for playing by reversing the above procedure. The front panel is unlatched and swung out of the way as shown in FIG. 4. The keyboard 14 is swung upwardly to a horizontal playing position. As the edge 54 of the slide bar 52 slides over the lobe 62, the slide bar 52 is forced outwardly to a cocked position. Upon alignment with the recess 58, the slide bar 52 is pulled inwardly by a spring means to automatically lock the keyboard 14 in the horizontal position. The keyboard keys automatically and accurately engage the hammer pickup fingers in the manner previously described herein. The section 27 is folded inwardly as shown in FIG. 4 and the panel section 26 is pivoted upwardly and latched. Thus, in a matter of minutes the piano 10 is ready to be played again. to a cocked position.

While the foregoing is directed to the preferred embodiment of the present invention, other and further embodiments of the invention may be devised without departing from the basic concept thereof, and the scope thereof is determined by the claims which follow.

I claim:

1. In a piano which includes a piano body having a frame work and strings therein, and designated action mechanisms having a plurality of pickup fingers associated therewith, each action mechanism causing a hammer to strike a designated string to form a musical note, and which piano further includes a separable keyboard assembly including a plurality of keys, the improvement which comprises:

(a) an elongate positioning rail for operatively aligning the pickup fingers and each action mechanism for engagement and disengagement relative to a designated key of the keyboard assembly, said positioning rail incorporating a plurality of slots for receiving the pickup fingers;

(b) means for selectively engaging and disengaging the plurality of keys with the action pickup fingers;

(c) means for fixedly attaching the keyboard assembly to the piano body at an operative position such that striking a designated key of the keyboard assembly causes a hammer to strike a designated string in the piano body to form a musical note; and (d) means for selectively altering the position of the keyboard assembly relative to the piano body between operative and inoperative positions.

2. The apparatus of claim 1 wherein said attaching means includes a connecting arm secured to the keyboard assembly and a support plate mounted to the piano body, said connecting arm and said support plate incorporating slots which are aligned upon positioning the keyboard assembly in an operative position, said attaching means further including a spring biased slide bar mounted to the keyboard assembly, one end of aid slide bar being simultaneously received in said aligned slots for locking the keyboard assembly in an operative position.

3. The apparatus of claim 1 wherein the pickup fingers comprise an elongate shaft connected to the piano hammers at one end thereof, the other end of said shaft being enclosed by a sheath means comprising an elongate flexible cylinder including an axial passage extending therethrough and further provided with an enlargement at one end thereof, said sheath means being frictionally connected to a lock nut which in turn is frictionally connected to said other end of said shaft.

4. The apparatus of claim 1 wherein said positioning rail further includes a cross bar connected thereto, said cross bar closing off the open ends of said plurality of slots and further including bracket means for attaching said positioning rail to the frame work of the piano body.

5. The apparatus of claim 4 wherein said positioning rail comprises two metal strips connected at right angles to each other, one of said strips incorporating the plurality of slots and lying in a generally horizontal plane, and the other of said strips extending downwardly from and substantially enclosing the slotted strip on three sides thereof, said downwardly extending strip further including extension members for connection to the frame work of the piano body.

6. The apparatus of claim 3 wherein said shaft includes an adjustment nut threadably secured to an upper end thereof for varying the stroke of the action pickup fingers.

7. The apparatus of claim 3 wherein said lock nut includes an hexagonal portion and a cylindrical portion, and further includes an axial passage for receiving a portion of said shaft therethrough perfecting a frictional connection therewith.

8. The apparatus of claim 1 wherein said selectively engaging means includes a forked extension fixedly attached to each of the keys.

9. The apparatus of claim 8 wherein said forked extension comprises a stiff metal member shaped into a plurality of segments angularly disposed relative to each other, one of said segments including a U-shaped slot for receiving one of the pickup fingers.

10. The apparatus of claim 9 wherein said one segment further includes a pair of spaced and converging edges leading to the open end of said U-shaped slot.

* * * * *